United States Patent [19]

Schutes

[11] Patent Number: 4,919,861

[45] Date of Patent: Apr. 24, 1990

[54] METHOD FOR CONDITIONING GOLF CLUB GRIP

[76] Inventor: Delvin D. Schutes, 1919 S. Los Altos, Mesa, Ariz. 85202

[21] Appl. No.: 357,803

[22] Filed: May 30, 1989

[51] Int. Cl.[5] ..... B32B 1/00; B32B 35/00

[52] U.S. Cl. ..... 264/36; 273/81.4; 273/32 B; 273/75; 29/78; 29/402.19; 17/66; 264/293; 81/489

[58] Field of Search ..... 273/81.4, 81 B, 73 J, 273/75, 81 R, 81 D, 67 DA; 264/162, 163, 293, 36; 29/402.19; 81/489

[56] References Cited

U.S. PATENT DOCUMENTS 1,452,326 4/1923 Tew ..... 264/36 X 1,930,167 10/1933 Goodwin ..... 264/293 X 1,936,351 11/1933 Dickson ..... 264/293 X 3,330,891 7/1967 Kent ..... 264/36

FOREIGN PATENT DOCUMENTS 451133 9/1948 Canada ..... 273/81 R

*Primary Examiner*—George J. Marlo

*Attorney, Agent, or Firm*—Tod R. Nissle

[57] ABSTRACT

A method for conditioning a used conventional rubber or composite rubber golf club grip to extend the useful life of the grip. The method utilizes a tool to increase the tackiness of the resilient rubber grip of a golf club by compressing the grip at selected points to form a scabrous surface which a golfer can more readily grasp and control during a golf stroke.

8 Claims, 1 Drawing Sheet

METHOD FOR CONDITIONING GOLF CLUB GRIP

This invention relates to a method for conditioning a used conventional rubber or composite rubber golf club grip to extend the useful life of the grip.

More particularly, the invention relates to a method for utilizing a tool to increase the tackiness of the resilient rubber grip of a golf club by compressing the grip at selected points to form a scabrous surface which a golfer can more readily grasp and control during a golf stroke.

In the era of Ben Hogan and other well known golfers, the grips on the handles of golf clubs were often made of leather. Leather grips have largely been superseded by elastic rubber and composite rubber grips. Eaton Corp., the world's largest manufacturer of golf club grips, sold over 30 million grips in 1988. The large majority of these grips were comprised substantially of a natural rubber, of a synthetic rubber like Eaton's EPDM which simulates natural rubber, or of a combination of synthetic and natural rubber. In certain of the grips manufactured by the Eaton Corp., cork, cotton flock, cord or other materials are included. Another famous manufacturer of golf equipment, MacGregor, also sells golf club grips made substantially from a natural and/or synthetic rubber composition. As used herein, the term "rubber" shall include materials which like the material in Eaton grips consist substantially of natural rubber and/or of a synthetic rubber which simulates natural rubber.

A particular advantage of conventional rubber golf club grips manufactured by Eaton Corp., MacGregor, and others is that the grips tend not to slip in the golfer's hands during a golf stroke. Conversely, a disadvantage of conventional rubber golf grips is that with use the outer surface of the grips becomes smooth and slippery. When rubber golf club grips become smooth and slick, they ordinarily are discarded and replaced with new grips. Replacing the rubber grips on a set of golf clubs is not inexpensive. A new grip costs from $3 to $8.

Accordingly, it would be highly desirable to provide a method for conditioning golf club grips to extend the useful life of the grips after they become smooth and slippery with use.

Therefore, it a principal object of the invention to provide a method for conditioning a used rubber golf club grip to provide tacky surface characteristics and extend the useful life of the grip.

A further object of the invention is to provide a method for reconditioning conventional rubber golf club grips which can be readily utilized by an individual having minimal skill and dexterity in utilizing conventional hand tools and which can be utilized without removing the grip from the handle of a golf club.

Another object of the instant invention is provide a method for conditioning a conventional rubber golf club grip with a tool which, without smoothing the grip surface and without abrading the grip surface to reduce the size of the grip, frictionally engages the grip to produce a scabrous surface that is tacky to the golfer's touch.

These and other further and more specific objects and advantages of the invention will be apparent to those skilled in the art from the following detailed description thereof, taken in conjunction with the drawings, in which.

Figures 1, 2, 3, 4, 5, 6, 7, 8:
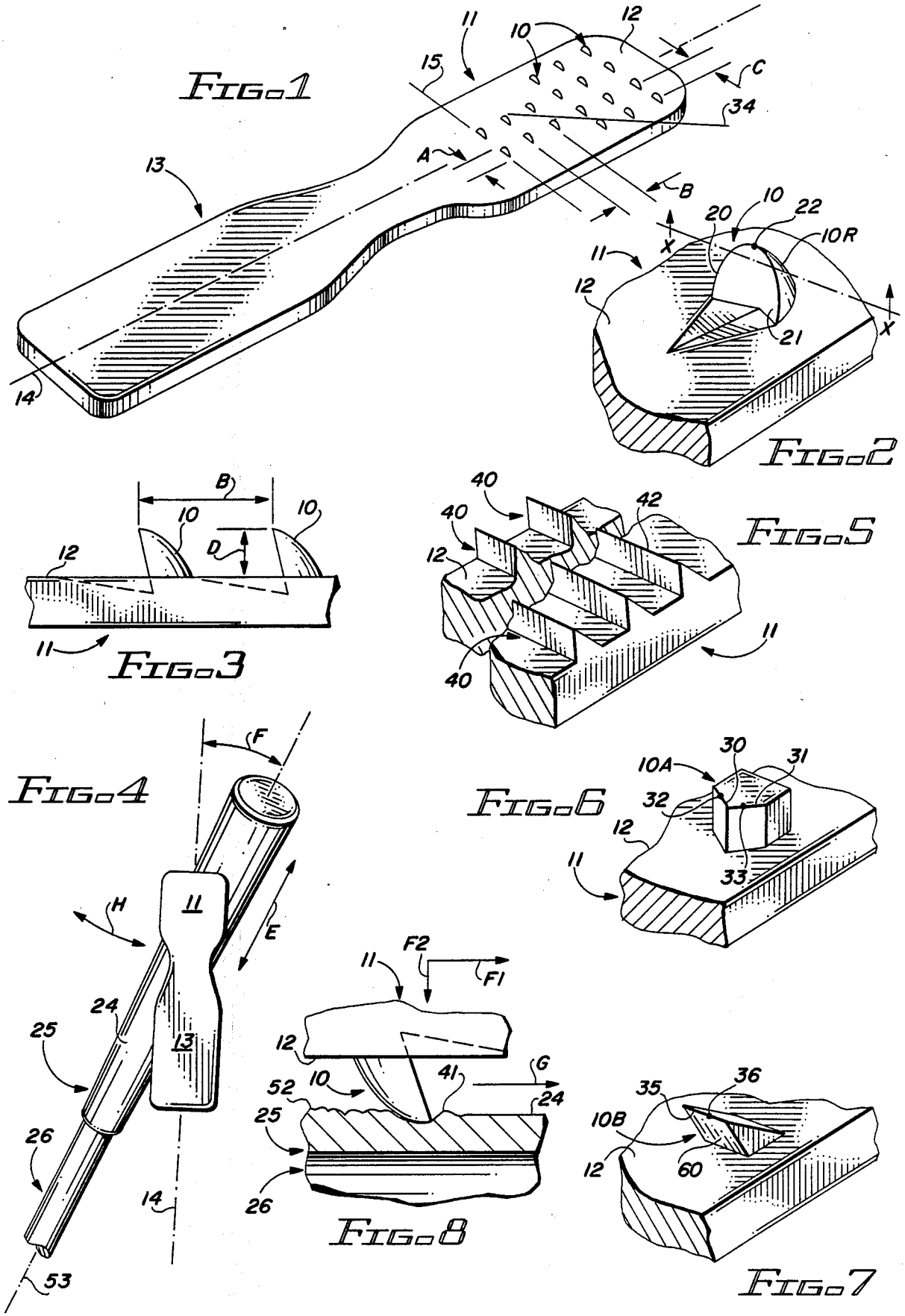
FIG. 1 is a perspective view illustrating a tool constructed in accordance with the invention and utilized to recondition conventional elastic rubber grips on golf clubs.
FIG. 2 is a perspective view illustrating construction details of a tooth on the tool of FIG. 1.
FIG. 3 is a side view illustrating a portion of the tool of FIG. 1 and further depicting construction details thereof.
FIG. 4 is a perspective view of the grip on a golf club in conjunction with the tool of FIG. 1 and illustrating the method of the invention.
FIG. 5 is a perspective view illustrating an alternate tooth embodiment for the tool of FIG. 1.
FIG. 6 is a perspective view illustrating another alternate embodiment of a tooth on the tool on FIG. 1.
FIG. 7 is a perspective view illustrating still another alternate embodiment of a tooth on the tool of FIG. 1; and, FIG. 8 is a side view of a tooth contacting the resilient surface of a conventional rubber golf club grip during the practice of the conditioning method of the invention.

Briefly, in accordance with my invention I provide a method for conditioning and increasing the tackiness of a used grip on the upper end of the handle of a golf club so a golfer can more readily grasp and control the grip during a golf stroke. The grip has an outer surface, a longitudinal axis, and is substantially comprised of an elastic rubber material. The method includes the step of contacting said outer surface with at least one outer ruffling edge portion of each of a plurality of spaced apart teeth attached to and outwardly projecting from a backing, the ruffling edge portion on any one of the teeth being spaced apart from said ruffling edge portions on the other of the teeth; and, drawing said edge portions over said grip to frictionally engage and resiliently compress and ruffle said surface to product raised protuberances on said surface and increase the tackiness of the grip. The spaced apart ruffling edges can each lie in one of a plurality of rows each comprised of a plurality of teeth centered on a line. The ruffling edge portion of each tooth in a row can be within three millimeters of the ruffling edge portion of an adjacent tooth in the row. Each row is canted with respect to the longitudinal axis of the backing. During the method of the invention the teeth are moved along the grip in a direction of travel which is at an angle with respect to the ruffling edge portions. The longitudinal axis of the backing can be perpendicular to the rows of teeth and can be canted with respect to the longitudinal axis of the grip. The smallest angle between the longitudinal axis of the backing and the longitudinal axis of the grip can be selected from and varied within the range of zero degrees to sixty degrees.

Turning now to the drawings, which depict the presently preferred embodiments and best mode of the invention for the purpose of illustrating the practise thereof and not by way of limitation of the scope of the invention and in which like reference characters represent corresponding elements throughout the several views, FIGS. 1 to 4 and 8 illustrate apparatus utilized in the presently preferred method of the invention. In the tool of FIG. 1, a plurality of teeth 10 are fixedly, rigidly secured to planar surface 12 of backing 11. Handle 13 is connected to backing 11. The longitudinal axis 14 bisects handle 13 and backing 11. Teeth 10 are arranged in a plurality of rows. Each row of teeth lies along a line which is perpendicular to longitudinal axis 14. For example, a pair of teeth 10 form a row which lies along line 15. Line 15 is perpendicular to axis 14. Each row of teeth can, if desired, be canted with respect to axis 14 at an angle other than ninety degrees. Three teeth 10 form a row which lies along canted line 34. If desired, the teeth 10 in the row along line 34 can be oriented such that the face 21 of each tooth is generally parallel to line 34.

In FIG. 1, the width, indicated by arrows A, of each tooth 10 is two millimeters. The distance, indicated by arrows B, between adjacent rows of teeth is typically three millimeters. The distance, indicated by arrows C, between a pair of adjacent ruffling edge portions, is two millimeters. What constitutes a "ruffling edge portion" is explained with reference to FIGS. 2 and 8. In FIG. 2, the convex ruffling edge portion 10R comprises that portion of the arcuate edge 20 at the periphery of face 21 of tooth 10. Edge 20 can be semi-circular, semi-elliptical, semiparabolic, or any other desired curvature. Edge portion 10R represents the tip of tooth 10, i.e., represents that portion of edge 20 above the dashed line X—X. Portion 10R has a center point 22. Point 22 lies midway along the length of portion 10R. When the tip of tooth 10 is drawn along the outer surface 24 of rubber grip 25 in the direction of arrow E in FIG. 8, convex arcuate portion 10R is the only part of edge 20 which contacts grip 25. The precise length of portion 10R will, as expected vary depending on the magnitude of the force used to press the tooth 10 against the surface 24 of grip 25. Regardless of the length of portion 10R the location of center point 22 generally remains fixed. In FIG. 1, the distance between ruffling edge portions of adjacent teeth 10 is indicated by arrow C. The distance indicated by arrow C is actually the distance between the center points 22 of each adjacent ruffling edge portion 10R.

While in the practise of the method of the invention the particular shape of the tooth 10 can vary, the tooth will always include at least one ruffling edge portion which contacts surface 24 along its length. Such a ruffling edge portion will always have a midpoint along its length. Such midpoints are used as references to determine the distance between the ruffling edge portions of adjacent teeth 10. For example, FIG. 6 illustrates an alternate embodiment 10A of a tooth. Tooth 10A includes a pair of intersecting ruffling edge portions 30 and 31. Assuming that edges 30 and 31 contact surface 24 along their entire length when the tool of FIG. 1 is utilized in the manner illustrated in FIG. 4, portion 30 has a center point 32 and portion 31 has a center point 33. Still another embodiment 10B of a tooth which can be utilized on the tool of FIG. 1 is illustrated in FIG. 7. The ruffling edge portion 35 of tooth 10B has center point 36.

In FIG. 5 a series of spaced apart ridges are attached to surface 12 of backing 11. Such an arrangement of ridges is not preferred in the practice of the invention. Teeth 10 are preferred because when, as shown in FIG. 8, a tooth 10 is drawn along grip 25 a portion 41 of the rubber material comprising the grip tends to bunch or accumulate immediately in front of ruffling edge portion 10R. The size of portion 41 and of protuberances 52 is exaggerated for purposes of clarity. The rubber material in portion 41 can, in part, elastically distend and escape laterally around ruffling edge portion 10R and can, in part, move under and be compressed by ruffling edge portion 10R. In other words, in FIG. 8 a part of the rubber material in portion 41 in FIG. 8 moves in a lateral direction which is perpendicular to and away from the plane of the paper. This lateral movement is caused by the movement of tooth 10 over grip 25 and moves said part of the rubber material away from its normal position on grip 25. As the tooth 10 continues to move in the direction of arrow G, the laterally displaced material resiliently returns to its normal position on grip 25 by moving in a direction of travel which is toward and perpendicular to the plane of the paper. While said part of the rubber material is laterally displaced, it travels under and is contacted by a part of edge portion 10R. Importantly, the convex arcuate shape of edge portion 10R facilitates such travel of elastic material around the tip of tooth 10. In contrast, when surface 12 is provided with ridges 40 in the manner illustrated in FIG. 5, rubber material in portion 41 must pass beneath ridge 40 along the entire length of ruffling ridge portion 42. Ruffling ridge portion 42 does not offer the side or peripheral passage of rubber material in a portion 41 in the same manner as a plurality of colinear adjacent teeth ruffling edge portions 10R. Edge portions 10R provide more of a point contact with surface 24. Edge portions 42 provide more of an extended linear contact with surface 24. The point contact provided by ruffling edge portions 10R minimizes the abrading of surface 24 which occurs during a method of the invention and more effectively produces the scabrous surface desired to increase the tackiness of the surface 24 of a used grip 25.

As shown in FIG. 8, as tooth 10 is manually or otherwise drawn over grip 25, raised protuberances and irregularities 52 are formed on surface 24. This conditioning of surface 24, when accomplished by drawing a plurality of teeth over surface 24 in FIG. 4 in the directions of arrows E, tends to produce a uniformly renewed, tacky grip surface 24.

Grip 25 and golf club shaft 26 have a common longitudinal axis or center line 53. When the tool of FIG. 1 is utilized to condition surface 24 of rubber grip 25, the angle F between the longitudinal axis 14 of the tool and axis 53 of grip 25 is in the range of zero to sixty degrees, preferably zero to thirty degrees. When angle F is greater than sixty degrees ruffling edge portions 10R on teeth 10 of the tool of FIG. 1 tend to act like knife edges and cut surface 24 instead of producing protuberances 52 on surface 24. Orienting the tool of FIG. 1 with axis 14 perpendicular to axis 53 and moving teeth 10 across surface 24 in the directions indicated by arrow H is not desired because the number of rows of teeth contacting grip 25 is minimized and the likelihood is increased that surface 24 will be unnecessarily scored or damaged.

It is important to note that the function of teeth 10 on the conditioning tool of FIG. 1 is not to smooth the outer surface 24 of grip 25. Surface 24 is, prior to utilization of the method of the invention, already smooth and slippery from use. The primary function of the conditioning tool is to uniformly ruffle surface 24 to make surface 24 tacky to the touch.

It is also important to note that a primary function of the teeth 10 on the conditioning tool FIG. 1 is not to abrade the outer surface 24 of grip 25. While there normally is a minor insignificant amount of abrading caused by a tooth 10 which is drawn over surface 24 of grip 25, abrading grip 25 is undesirable for several reasons. First, abrading grip 25 reduces the size of the grip, altering the feel of the grip in a golfer's hands. Second, it is most difficult to uniformly abrade the surface of a grip 25. Contours are formed in the grip during abrading which alter the shape of surface 24 making the grip feel unnatural in the hands of a golfer. Finally abrading the grip replicates sanding or smoothing of the grip. This is contrary to the primary objective of the method of the invention, which is to ruffle grip 25 to produce to produce a tacky, scabrous surface 24.

In order to provide a conditioning tool which will produce a scabrous grip 25 in accordance with the method of the invention, the teeth 10 utilized must have a shape and dimension which falls within certain perimeters. As noted, the spaced apart ridges 40 illustrated in FIG. 5 are not preferred in the practise of the invention. Teeth 10 like those illustrated in FIGS. 2, 6, and 7 enable the flexible rubber material in grip 24 to flow around teeth 10 minimizing the tendency of the rubber material to tear free from the grip 25. The ridges 40 in FIG. 5 tend to require rubber material in grip 25 to move "through" or under ridges 40 increasing the likelihood grip 25 will be unnecessarily scored or damaged. Ridges 40 also do not provide the localized point contact and increased pressure afforded by teeth 10.

If the teeth 10 are too large, surface 24 will be excessively scored, again resulting in the tearing of undesirable amounts of material from grip 25. Consequently, the width, indicated by arrows A, of the ruffling edge portions 10R is preferably no greater than three millimeters. The height of teeth 10 indicated by arrows D in FIG. 3, can vary as desired as long as each tooth 10 has approximately the same height or as long as the tips of all teeth 10 generally lie in a single common flat plane.

If the teeth 10 in a row are spaced too far apart, this reduces the number of teeth 10 which simultaneously contact the surface 24 of grip 25 and tends to put an undesirable amount of pressure on each tooth 10 contacting grip 25. This results in an increased tendency to tear grip 25 or to produce an unsightly score line in the directions of travel E of the teeth 10 up and down the surface of the grip. Accordingly, it is preferred that the ruffling edge portions 10R of the teeth 10 in a row be relatively closely spaced. In FIG. 1, a distance C between the centerpoints 22 of immediately adjacent edge portions 10R is four millimeters or less, preferably three millimeters or less.

It is preferred that teeth 10 are on a backing 11 which has a flat planar surface 12, or are on a concave surface which more closely opposes and contours to the convex surface 24 of the grip. The utilization of a backing 11 with a convex surface is preferably avoided because the convex surface (assuming all teeth are of equal height) reduces the number of teeth which simultaneously contact the surface 24 of grip 25. Reducing the number of teeth which simultaneously contact surface 24 places more pressure on each tooth 10 and increases the likelihood that undesirable scores or tears will be formed on surface 24.

The distance between rows of teeth 10, indicated by arrows B in FIG. 1, is less crucial but must also not be too great. The distance B between rows of teeth is six millimeters or less, preferably four millimeters or less.

The ruffling edge portions 10R and 35 of the teeth in FIGS. 2 and 7, respectively, are well suited to the method of the invention because edge portions 10R and 35 and faces 21 and 60 are generally perpendicular to or are at least canted with respect to the direction of travel G of the teeth along the grip 25 on the shaft 26 of a golf club. This enables faces 21 and 60 to cooperate with edges 10R and 35, respectively, to compress, knead and make scabrous surface 24 of grip 25. As illustrated in FIG. 8, when a tooth 10 is pulled along the smooth used outer surface 24 of a grip 25, the elastic rubber tends to bunch 41 forwardly of tooth 10. As the tooth 10 continues to move in the direction of arrow E, rubber 41 must squeeze beneath and around tooth 10. Such a squeeze or compression of the rubber beneath the ruffling edge portion 10R of tooth 10, produces a scabrous, tacky surface having protuberances and irregularities 52.

The method of the invention cannot be utilized on leather grips. The conditioning tool of FIG. 1 would seriously damage and, practically speaking, would destroy leather grips.

Teeth 10 are rigid or substantially rigid. Backing 11 can be formed of metal such that teeth 10 can be produces or raised from backing 11 by the oblique stroke of a sharp punch.

When an individual bounces on a trampoline, the trampoline repeatedly elastically catches the individual as he falls and then throws him upwardly away from the trampoline. Similarly, the bunched or raised portion 41 of rubber formed forwardly of tooth 10 in FIG. 8 tends to push tooth 10 in a direction opposite that of the direction indicated by arrow E. If a tooth with an improper shape and dimension is utilized in the practice of the invention, the tooth passes over portion 41 by tearing it free from grip 25. This is why the shape and dimension of tooth 10 is critical in the practice of the invention. A great variety of tooth sizes, shapes and/or spacings can be selected which will not produce a scabrous grip surface without unduly damaging grip 25.

Having described my invention in such terms as to enable those skilled in the art to understand and practise it, and having identified the presently preferred embodiments thereof, I claim:

1. A method for conditioning and increasing the tackiness of a used grip on the upper end of a handle of a golf club so a golfer can more readily grasp and control the grip during a golf stroke, said grip having an outer surface and a longitudinal axis and being substantially comprised of an elastic rubber material, said method including the steps of (a) contacting said outer surface with at least one ruffling edge portion of each of a plurality of spaced apart teeth attached to and outwardly projecting from a backing, said ruffling edge portion on any one of said teeth being spaced apart from ruffling edge portions on the remaining ones of said teeth, said backing having an axis; and, (b) drawing said ruffling edge portions over said grip to frictionally engage and resiliently compress and ruffle said surface to produce raised protuberances on said surface and increase the tackiness of said grip.

2. The method of claim 1 wherein said spaced apart ruffling edge portions each lie in one of a plurality of rows each comprised of a plurality of teeth lying along a common line, said ruffling edge portions of each tooth in one of said rows having a center point within three millimeters of the center point of said ruffling edge portion of an immediately adjacent tooth in said row, each of said rows and said lines being canted with respect to said axis of said backing.

3. The method of claim 2 wherein said axis of said backing is canted with respect to the longitudinal axis of said grip.

4. The method of claim 3 wherein the smallest angle between said axis of said backing and the longitudinal of said grip during step (b) is selected from and varies within the range of zero degrees to sixty degrees.

5. The method of claim 4 wherein said rubber material is natural rubber.

6. The method of claim 1 wherein said rubber material is natural rubber.

7. A method for conditioning and increasing the tackiness of a used grip on the upper end of a handle of a golf club so a golfer can more readily grasp and control the grip during a golf stroke, said grip having an outer surface and a longitudinal axis and being substantially comprised of an elastic rubber material, said method including the steps of (a) contacting said outer surface with at least one convex arcuate ruffling edge portion of each of a plurality of spaced apart teeth attached to and outwardly projecting from a backing, said ruffling edge portion on any one of said teeth being spaced apart from ruffling edge portions on the remaining ones of said teeth, said backing having an axis; and, (b) drawing said ruffling edge portions over said grip in a selected direction of travel to frictionally engage and resiliently compress and ruffle said surface to produce raised protuberances on said surface and increase the tackiness of said grip, said convex arcuate portion elastically displacing portions of said rubber material (i) beneath a section of said ruffling edge portion, and, (ii) laterally with respect to said direction of travel.

8. The method of claim 5 wherein said rubber material is natural rubber.

* * * * *